US006553976B1

(12) United States Patent
Threadingham et al.

(10) Patent No.: US 6,553,976 B1
(45) Date of Patent: Apr. 29, 2003

(54) ASSEMBLY AND METHOD FOR RECEIVING HYDROCARBON MATERIAL

(75) Inventors: Charlie P Threadingham, Westland, MI (US); Eric D. Ellsworth, Ypsilanti, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/682,745

(22) Filed: Oct. 12, 2001

(51) Int. Cl.[7] ..... F02M 37/04
(52) U.S. Cl. ..... 123/519; 123/520
(58) Field of Search ..... 123/516, 518, 123/519, 520, 198 D

(56) References Cited

U.S. PATENT DOCUMENTS

| | | | | | |
|---|---|---|---|---|---|
| 4,083,344 | A | * | 4/1978 | Sakurai et al. | 123/520 |
| 4,279,233 | A | * | 7/1981 | Tobita et al. | 123/519 |
| 5,056,494 | A | * | 10/1991 | Kayanuma | 123/519 |
| 5,143,041 | A | * | 9/1992 | Franzke | 123/520 |
| 5,361,743 | A | * | 11/1994 | Denz et al. | 123/519 |
| 5,456,237 | A | * | 10/1995 | Yamazaki et al. | 123/520 |
| 5,501,198 | A | * | 3/1996 | Koyama | 123/520 |
| 5,562,084 | A | * | 10/1996 | Shimamura | 123/520 |
| 5,592,922 | A | * | 1/1997 | Denz | 123/520 |
| 5,613,477 | A | * | 3/1997 | Maeda | 123/519 |
| 5,632,252 | A | * | 5/1997 | Hyodo et al. | 123/520 |
| 5,676,116 | A | * | 10/1997 | Kin | 123/518 |
| 5,806,500 | A | * | 9/1998 | Fargo et al. | 123/520 |
| 5,845,625 | A | * | 12/1998 | Kidokoro et al. | 123/516 |
| 6,161,526 | A | * | 12/2000 | Sakata et al. | 123/519 |
| 6,253,743 | B1 | * | 7/2001 | Hyodo et al. | 123/520 |
| 6,276,193 | B1 | * | 8/2001 | Benjey | 123/118 |
| 6,279,548 | B1 | * | 8/2001 | Reddy | 123/520 |

OTHER PUBLICATIONS

US 6,349,741, 2/2002, Sato et al. (withdrawn)*

* cited by examiner

*Primary Examiner*—Thomas N. Moulis
(74) *Attorney, Agent, or Firm*—Dykema Gossett

(57) ABSTRACT

An assembly 10 which includes primary and secondary hydrocarbon material reception and storage devices 22, 24 in a cascaded and communicative relationship. Particularly, the device 24 receives and stores hydrocarbon emissions 20 which emanate from the device 22. Device 24 further includes a filter 50 through which purging air is communicated to the devices 22, 24. Further, device 24 includes a condensation removal portion 52 which allows condensation 92 to be vented from the device 24 and a selectively closeable vent portion 54 which allows the device 24 and the assembly 10 to be periodically tested.

2 Claims, 2 Drawing Sheets

ASSEMBLY AND METHOD FOR RECEIVING HYDROCARBON MATERIAL

BACKGROUND OF INVENTION

The present invention generally relates to an assembly and method for receiving and storing hydrocarbon material and more particularly, to an assembly having a pair of discrete devices which cooperatively receive hydrocarbon emissions from a vehicular fuel tank.

A conventional carbon containing device, often referred to as "canister", is typically deployed within a vehicle of the type having a hydrocarbon fuel storage tank. More particularly, the canister is physically and communicatively coupled to the storage tank and is effective to absorb and temporarily store hydrocarbon material (e.g., hydrocarbon emissions) emanating from the tank, thereby reducing the likelihood that the hydrocarbon material will be communicated into the atmosphere. When the vehicle is activated or operating, ambient or "fresh" air is drawn into the canister in order to force the stored hydrocarbon material into the engine where it is burned, thereby "purging" the canister and increasing the storage capacity of the canister, effective to allow the canister to again operatively receive and temporarily store hydrocarbon material.

While this approach reduces the amount of emitted hydrocarbons, such hydrocarbon material may potentially be emitted if the canister has become saturated or after a relatively long period of vehicular inactivity has occurred.

The present invention thus attempts to further reduce the mount of emitted hydrocarbons and provides other desired benefits which are set forth in greater detail below.

SUMMARY OF INVENTION

It is a first non-limiting advantage of the present invention to provide an assembly and method for receiving and storing/absorbing hydrocarbon material which addresses some or all of the limitations of the conventional approach described above.

It is a second non-limiting advantage of the present invention to provide a method for purging the assembly.

It is a third non-limiting advantage of the present invention to provide an assembly and method that minimizes the effects of water or condensation which may be transmitted to or which may occur within the assembly.

It is a fourth non-limiting advantage of the present invention to provide an assembly and method for receiving and storing/absorbing hydrocarbon material that includes a selectively closeable vent which is adapted to allow the assembly to be selectively tested and which is adapted to allow the assembly to be selectively purged.

According to a first aspect of the present invention, an assembly is provided for minimizing hydrocarbon emissions from a motor vehicle, the assembly including a first device for receiving hydrocarbon emissions from a vehicle fuel storage device (e.g., tank); and a second device coupled to the first device for receiving hydrocarbon emissions from the first device.

According to a second aspect of the present invention, an apparatus for use in combination with a vehicular canister is provided. The apparatus comprises a generally hollow body which may be selectively attached to the canister and which contains hydrocarbon absorbing material and an air filter, the filter being effective to allow the vehicular canister and the apparatus to be selectively purged to minimize the amount of particulates entering the vehicular canister during purging.

According to a third aspect of the present invention, a method is provided for minimizing hydrocarbon emissions from a vehicular storage canister into the ambient environment, the method including the steps of receiving hydrocarbon emissions from a fuel storage device in a first device, and receiving the hydrocarbon emissions from the first device in a second device coupled to the first device.

These and other features, aspects, and advantages of the present invention will become apparent from a reading of the following detailed description of the preferred embodiment of the invention and by reference to the following drawings.

DETAILED DESCRIPTION

Figure 1:
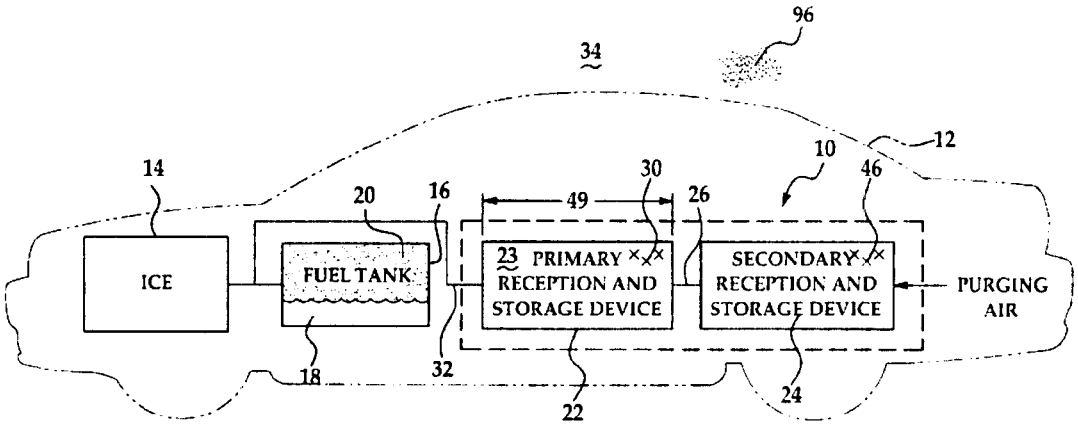
FIG. 1 is a block diagram of an assembly for receiving and storing hydrocarbon material which is made in accordance with the teachings of the preferred embodiment of the invention and which is shown as being operatively disposed within a vehicle.

Referring now to FIG. 1, there is shown a material reception and storage assembly 10 which is made in accordance with the teachings of the preferred embodiment of the invention and which is operatively deployed within a vehicle 12 of the type having an internal combustion engine 14 and a fuel tank 16. It should be appreciated that only a portion of the vehicle 12 is shown within FIG. 1 and that vehicle 12 may comprise a commercially available and conventional gasoline or "fossil fuel powered" type vehicle or a hybrid vehicle, such as and without limitation a hybrid electric vehicle.

Particularly, the fuel tank 16 is adapted to receive and store a quantity of fuel 18 having hydrocarbon emissions 20. As is further shown, the fuel tank 16 is physically and communicatively coupled to the internal combustion engine 14 and is adapted to selectively provide the contained fuel 18 (including emissions 20) to the internal combustion engine 14, effective to allow the delivered fuel 18 to be selectively mixed with air and combusted in order to allow the internal combustion engine 14 to produce torque.

The material reception and storage assembly 10 includes a conventional or primary storage or canister device 22 and a secondary canister or storage device or apparatus 24 which is physically and communicatively coupled to the primary or conventional storage device 22 by a generally hollow pipe or tube 26. The primary device 22 receives emissions 20 from the fuel tank 18 while secondary device 24, as is explained below, receives emissions 20 from the primary device 22.

As should be appreciated, conventional canister 22 includes a certain amount of carbon 30 which resides within the interior portion 23. Further, as shown, canister 22 is physically and communicatively coupled to the fuel tank 18 and to the engine 14 by the use of generally hollow pipe or tube 32. In this manner, when the internal combustion engine 14 is deactivated, the hydrocarbon emissions 20, emanating from the fuel tank 18, are communicated to the interior portion 23 of the canister 22 and received and "captured by" or stored within or "temporarily absorbed by"

the contained carbon 30, effective to minimize the amount of emissions 20. Device 22 may be round and of a desired size. Moreover, device 22 may be formed into one of a wide variety of shapes and sizes.

Figure 2:
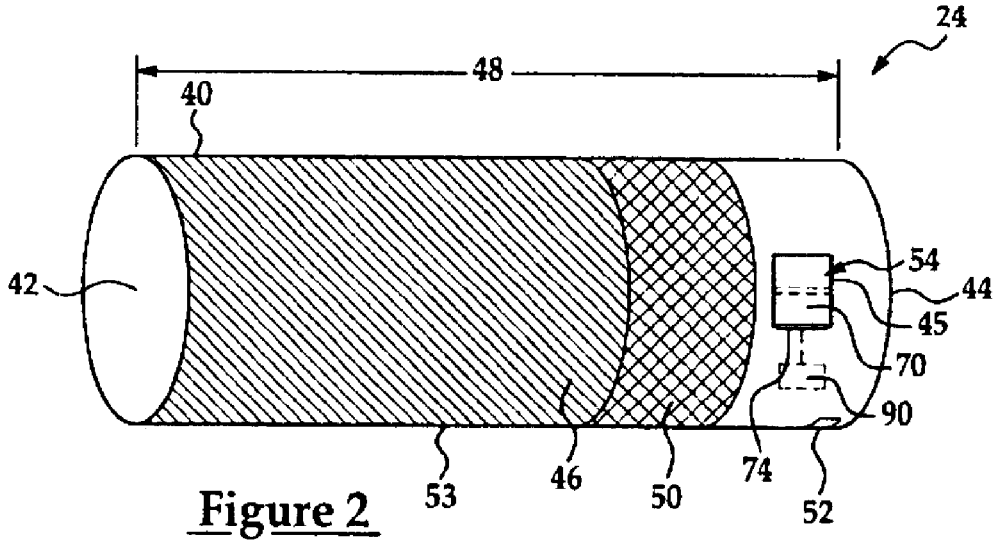
FIG. 2 is a side view of the assembly which is made in accordance with the teachings of the preferred embodiment of the invention shown in FIG. 1.

Secondary material reception and storage device or canister 24, as is best shown in FIG. 2, includes a generally elongated, round, and hollow body 40 having a pair of opposed ends 42, 44. Other shapes may be utilized in other non-limiting embodiments of the invention and it should be appreciated that end 42 is open (e.g., allows communication between the ambient environment 34 and the interior of the body 40) while end 44 is closed. Further, device 24 includes a certain quantity of carbon material 46 which, in one non-limiting embodiment of the invention, nominally extends about three-quarters along the length 48 of the device 24. Other amounts of carbon material 46 may be utilized in other non-limiting embodiments.

Further, device 24 includes an air filter 50 which is frictionally or otherwise secured within the body 40, which engages the carbon 46, and which is positioned between the contained carbon 46 and the end 44. In one non-limiting embodiment, carbon 46 fills the volume of the interior of body 40 which resides between end 42 and the air filter 50. Additionally, the device 24 includes an opening 45 which is created through the body 40 and which is positioned between the filter 50 and the end 44, and a vent assembly 54 which, in one non-limiting embodiment, selectively opens and closes the opening 45 in a manner and for a purpose which is more fully delineated below.

Further, as shown best in FIG. 1, end 42 is physically and communicatively coupled to the generally hollow pipe or tube 26 and, in this manner, tube 26 allows the interior of body 40 to communicate with the interior 23 of device 22. A second opening 52 is formed within the underside 53 of body 40, between opening 45 and the end 44, and allows any water and condensation, which may enter the interior of the body 40 or which may form within body 40, to be vented, thereby minimizing the amount of water or condensation within the device 24 or other portions of the vehicle 12. It should be appreciated that openings 45 and 52 may be of any substantially desired and respective shape or size. In the most preferred embodiment of the invention, the length 48 of body 40 is about one-tenth of the length 49 of the primary canister 22 and the volume of body 40 is about one-tenth the volume of the primary canister 22 (e.g., device 24 is about one-tenth "the size" of device 22). Other lengths and volumes may be employed for the device or apparatus 24.

Figure 3:
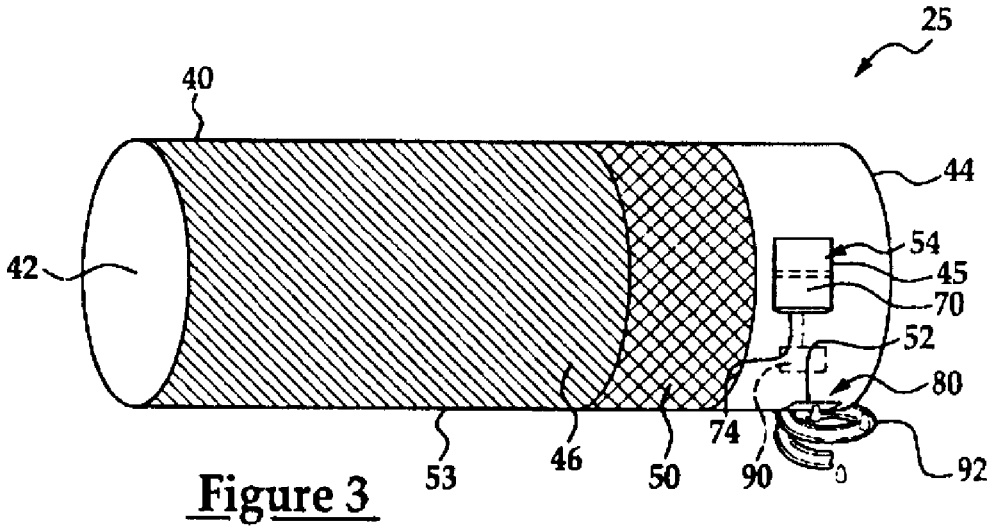
FIG. 3 is a side view of a assembly for receiving and storing hydrocarbon material made in accordance with the teachings of an alternate embodiment of the invention

As best shown in FIGS. 2 and 3, vent assembly 54 includes, in one non-limiting embodiment, a flap or member 70 which has substantially the same size and shape as the opening 45 and which is pivotally coupled to the body 40 by a hinge member 74 which biases the flap 70 in a open position, effective to "normally" allow the interior of the body 40 to communicate with the ambient environment 34 through the opening 45. Vent assembly 54 further includes a motor or controller 90 which is coupled to the hinge member 74 and which receives commands from a vehicle controller (not shown) which causes the motor or controller 90 to selectively move the flap 70 to a closed position in which the flap 70 overlays the opening 45 and substantially prevents communication between the ambient environment 34 and the interior of the body 40 through the opening 45. Motor or controller 90 may also, in an alternate embodiment of the invention, be remotely located from the assembly 24. Vent assembly 54 may also comprise a normally open solenoid assembly or any other type of conventional and selectively closeable assembly. That is, in this alternate embodiment, motor/controller 90 is replaced by a selectively energizable coil or inductor and flap 70 is replaced by a member which closes the opening 45 when the coil or inductor is energized and which is removed from the opening 45 when the coil or inductor is deenergized. Another selectively closeable vent assembly, which is substantially similar to vent member 54, may be used to selectively close the opening 52 upon the receipt of commands from the vehicle controller or another controller.

In an alternate non-limiting embodiment, a secondary canister or device 25 is shown in FIG. 3, wherein the second vent or opening 52 may communicate with a convoluted or labyrinth type "slide" or member 80 which is attached to, or which is integrally formed with, the body 40 and which receives the condensation or other liquid 92 transmitted to and/or formed within the body 40. Particularly, the member 80 slows the flow or the speed of the received condensation or liquid 92 from the body 40 in order to substantially contain the liquid or condensation 92 in a relatively small and controlled area (i.e., relatively rapidly moving liquid or condensation 92 may travel to various vehicular locations which are remote from the assembly 10 and undesirably cause damage) while concomitantly reducing the likelihood of "splash" or reentry into the body 40.

Thus, as should be evident from the above-description, the canisters or material reception and storage devices 22 and 24 cooperatively form a cascaded discrete hydrocarbon material absorption and reception arrangement or assembly which cooperatively reduces the likelihood of hydrocarbon emission into the ambient environment 34.

In operation, hydrocarbon emissions 20, which emanate from the device 22, are communicated to the pipe or tube 26 and are then communicated to the interior of the body 40 of the device 24. The communicated emissions 20 are then stored within the carbon 46. The assembly 10 is selectively purged by the introduction of ambient air 34 through opening 45, through air filter 50, and through the contained carbon 46 and 30, thereby allowing hydrocarbon material which may be stored within the canisters 22 and 24 to be positively removed and communicated into the engine 14, through pipe 32, where it is substantially "burned" or consumed by engine 14. This purging air may be forced to enter the device 24 by a pump (not shown).

The air filter 50 reduces the likelihood that airborne particulates 96 will enter the assembly 10. Further, condensation or liquid 92, within the secondary assembly 24, is removed through the condensation removal opening 52. Further, in the most preferred embodiment of the invention, the motor or coil 90 selectively closes the flap or member 70 in order to allow conventional vacuum or diagnostic testing to occur through and/or within the devices 22, 24. Opening 52 may be similarly and selectively closed in order to allow such tests to occur. Alternatively, the relatively small opening 52 may remain open and these conventional tests may be adapted to account for this opening 52.

It should be appreciated that the foregoing cascaded assembly 10 provides a means for minimizing the amount of hydrocarbon emissions transmitted to ambient 34. It should be further appreciated that discrete (i.e., physically separated devices 22, 24) have been found to perform better than one single large carbon containing device because the received hydrocarbon emissions 20 tend to become evenly distributed throughout the entire contained carbon within a single device, thereby reducing a substantially "clean portion" or "uncontaminated portion" with which to absorb emissions which my emanate during vehicular inactivity and therefore further reduces the overall absorption capacity of the contained carbon (e.g., the secondary device 24 is not primarily used to receive emissions 20 from the fuel tank 18 and hence retains its capacity to absorb emissions 20. Moreover, it has been discovered that it is advantageous to allow most, if not substantially all, of the volume of a devices, such as device 22, 24, to be periodically and substantially and completely purged in order to increase the operating life of the respectively contained carbon 30, 46. A large single unit or assembly generally does not allow such a desired "complete purging" to occur. That is, for example and without limitation, such a large unit requires an inordinate amount of time or a relatively large and expensive pump assembly for such a complete purge to occur. Thus, it has been found to be desirable to provide and/or utilize a relatively small secondary device, such as device 24, instead of a relatively large single carbon containing canister device. Moreover, it should be further appreciated that the foregoing secondary canister 24 not only provides the foregoing benefits but further reduces the amount of undesired airborne particulate and condensation to the vehicle 12.

It is to be understood that the invention is not limited to the exact construction and method which has been illustrated above, but that various changes and modifications may be made without departing from the spirit and the scope of the inventions as are delineated within the following claims.

What is claimed is:

1. An assembly for minimizing hydrocarbon emissions from a motor vehicle having an internal combustion engine and a fuel tank, comprising:

a first canister device for receiving hydrocarbon emissions emanating from the fuel tank; and a second canister device, coupled to said first device, for receiving hydrocarbon emissions emanating from the first device, with said second device comprising:

a generally hollow body for absorbing hydrocarbon emissions emanating from the first device;

an air filter, coupled to said generally hollow body, for minimizing the amount of particulates entering the first device;

a drain for allowing condensation to be vented from said assembly; and a convoluted slide in communication with said drain.

2. An assembly according to claim 1, further comprising a vent operably movable between a closed position and an open position.

* * * * *